US007820953B2

(12) United States Patent
Lee

(10) Patent No.: US 7,820,953 B2
(45) Date of Patent: Oct. 26, 2010

(54) MICROWAVE OVEN AND RADIATING STRUCTURE OF MICROWAVE IN MICROWAVE OVEN

(75) Inventor: Sang Ryul Lee, Masan-si (KR)

(73) Assignee: LG Electronics Inc., Seoul (KR)

( * ) Notice: Subject to any disclaimer, the term of this patent is extended or adjusted under 35 U.S.C. 154(b) by 810 days.

(21) Appl. No.: 10/575,857

(22) PCT Filed: Oct. 15, 2004

(86) PCT No.: PCT/KR2004/002635

§ 371 (c)(1),
(2), (4) Date: May 7, 2007

(87) PCT Pub. No.: WO2005/038349

PCT Pub. Date: Apr. 28, 2005

(65) Prior Publication Data

US 2007/0272684 A1 Nov. 29, 2007

(30) Foreign Application Priority Data

Oct. 16, 2003 (KR) ..... 10-2003-0072126
Oct. 16, 2003 (KR) ..... 10-2003-0072127

(51) Int. Cl.
*H05B 6/74* (2006.01)

(52) U.S. Cl. ..... 219/751

(58) Field of Classification Search ..... 219/751, 219/745–750, 726, 756
See application file for complete search history.

(56) References Cited

U.S. PATENT DOCUMENTS 4,421,968 A * 12/1983 Osepchuk ..... 219/749
4,751,357 A * 6/1988 Boulard ..... 219/726
4,808,784 A * 2/1989 Ko ..... 219/746
5,841,114 A * 11/1998 Jeong ..... 219/761
5,919,391 A * 7/1999 Jun ..... 219/746

FOREIGN PATENT DOCUMENTS

KR 10-1999-0017331 5/1999
KR 1999-002362 8/1999

* cited by examiner

*Primary Examiner*—Daniel Robinson
(74) *Attorney, Agent, or Firm*—KED & Associates, LLP

(57) ABSTRACT

There is provided a microwave oven. In the microwave oven, a screw covering part is protruded toward an inside of a waveguide for an installation of a motor, a convergence preventing part is formed at a portion of a cavity with a shape corresponding to that of the screw covering part and at a location corresponding to that of the screw covering part, and an elevated portion formed by modifying a portion of the cavity in order to uniformly distribute microwave scattered by a stirrer fan. Therefore, the microwave can be distributed more uniformly about the cavity and thereby food can be cooked more evenly and speedily.

15 Claims, 3 Drawing Sheets

MICROWAVE OVEN AND RADIATING STRUCTURE OF MICROWAVE IN MICROWAVE OVEN

TECHNICAL FIELD

This invention is related to a microwave oven, and more particularly, to a microwave radiating structure of microwave oven, in which microwave is more effectively distributed in a cavity, such that users can cook food evenly in a convenient way.

BACKGROUND ART

A microwave oven is a cooking device that cooks food by passing a microwave through the food. The microwave oven uses a magnetron to generate the microwave from an electric current.

Generally, a microwave oven is a device that is used to heat food by radiating microwave generated from a magnetron to the food when electric current is applied to electric components of the device.

Such a microwave oven is classified into a household microwave oven having a small magnetron and a commercial microwave oven having a large (or a plurality of) magnetron. The microwave oven is further classified according to a heating method into a glass tray method rotating the food and a stirrer fan method scattering microwave radiated into the cavity. The former is generally applied to the household microwave oven while the latter is applied to the commercial microwave oven. In the stirrer fan method, a stirrer is used to uniformly distribute the microwave about a cavity where food is loaded. Since the commercial microwave oven is generally used at convenience stores where the microwave oven is frequently used and restaurants where a large amount of the food should be quickly heated, the commercial microwave oven needs relatively high power output compared with the household microwave oven.

A microwave oven of the stirrer fan method includes: a magnetron for generating microwave; a waveguide provided at an upper side and lower side of a cavity, for guiding the generated microwave from the magnetron toward a cavity, in which food is loaded; a stirrer fan disposed at an outlet of the waveguide; and a motor for driving the stirrer fan. To fix the motor on an outside surface of the waveguide, a screw is used and the screw is protruded from an inside surface of the waveguide. A screw covering part is provided at the inside surface of the waveguide, where the screw is protruded, in order to prevent the protruded screw from interrupting the microwave flow.

In operation, the microwave generated at the magnetron passes from an inlet of the waveguide and to an outlet of the waveguide, and enters the cavity while scattered and reflected by the stirrer fan. The microwave can be uniformly distributed about the cavity owing to the stirrer fan and thereby food can be cooked evenly.

However, the related art structure for radiating microwave has several drawbacks.

The screw covering part narrows the microwave passage in the waveguide and thereby the microwave is converged with an undesired pattern, this causes the microwave to be unevenly distributed about the cavity, such that the cavity can be partially stained with soot due to partial exposure to intensive microwave and of cause food cannot be evenly cooked.

Further, though the stirrer fan scatters and reflects the microwave into the cavity, the microwave is not sufficiently distributed about the cavity so that food cannot be cooked evenly.

Furthermore, because of the non-uniform distribution of the microwave in the cavity, it takes much more time to cook the food.

DISCLOSURE

Technical Problem

Accordingly the present invention is directed to a microwave oven and radiating structure of microwave in microwave oven that substantially obviate one or more problems due to limitations and disadvantages of the related art.

An object of the present invention is to provide a microwave oven and radiating structure of microwave in microwave oven, in which microwave is uniformly distributed about a cavity.

Another object of the present invention is to provide a microwave oven and radiating structure of microwave in microwave oven, in which a cavity can be maintained clean without being stained with soot and food can be cooked more speedily.

A further another object of the present invention is to provide a microwave oven and radiating structure of microwave in microwave oven, in which food is heated more evenly so that cooking of the food can be done more speedily.

Technical Solution

To achieve these objects and other advantages and in accordance with the purpose of the invention, as embodied and broadly described herein, there is provided a microwave oven including: a cavity for accommodating food to be cooked, of which at least one side defining an opening; a door for shielding the opening selectively; a magnetron disposed at an outside of the cavity, for generating microwave; a waveguide for guiding the generated microwave into the cavity; a stirrer fan disposed at an outlet of the waveguide, for scattering the microwave guided by the waveguide; a motor fixed at an outside of the waveguide and of which shaft is connected with the stirrer fan; a screw covering part formed by modifying a portion of the waveguide to accommodate a motor fixing screw; a convergence preventing part formed at a portion of the cavity, with a shape corresponding to that of the screw covering part and at a location corresponding to that of the screw covering part; and an elevated portion formed by modifying a portion of the cavity, for uniformly distributing the microwave scattered by the stirrer fan.

In another aspect of the present invention, there is provided a microwave radiating structure of a microwave oven including: a magnetron disposed at an outside of a cavity, for generating microwave; a waveguide for guiding the generated microwave into the cavity; a stirrer fan disposed at an outlet of the waveguide, for scattering the microwave guided by waveguide; a motor fixed at an outside of the waveguide and of which shaft is connected with the stirrer fan; and a convergence preventing part provided at a location corresponding to that of the motor, the convergence preventing part being recessed toward an inside of the cavity.

In a further another aspect of the present invention, there is provided a microwave radiating structure of a microwave oven comprising: a cavity in which food is loaded; a waveguide guiding a microwave into the cavity; a motor disposed at an outlet of the waveguide; a stirrer fan connected with the motor by a shaft coupling, for scattering the microwave; and an elevated portion formed by modifying a plate of cavity, for uniformly distributing the scattered microwave about the cavity.

Advantageous Effects

A microwave oven of the present invention is provided such that food can be cooked more speedily and of course microwave can be distributed more uniformly about a cavity.

Further, microwave is more efficiently used to cook a food.

BEST MODE

A microwave oven and its microwave radiating structure according to the present invention will now be described more fully with reference to the accompanying drawings.

Figure 1:
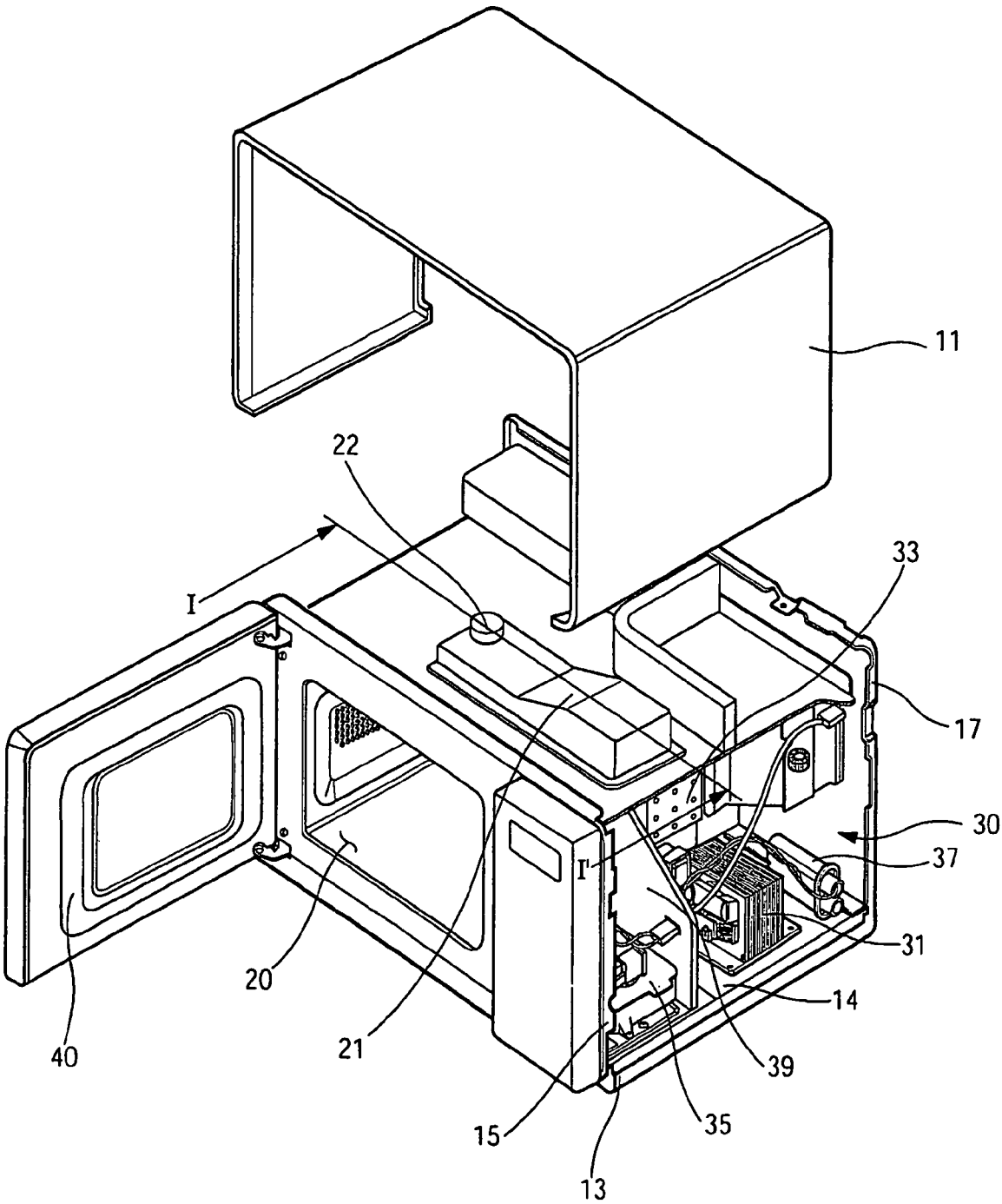
FIG. 1 is an exploded perspective view of a microwave oven according to the present invention.

FIG. 1 is an exploded perspective view of a microwave oven according to the present invention.

Referring to FIG. 1, a microwave oven includes an outer case forming the exterior of the microwave oven, a cavity 20 in which food is loaded, and an electric component chamber 30 in which electric components are mounted. Further, a door 40 is provided at a front of the cavity 20, for shielding the cavity 20 selectively.

The structure of the microwave oven will now be described.

The outer case forms the exterior of the microwave oven, and as well covers and protects the cavity 20. Therefore, the outer case may be made of an iron plate having a desired strength. The outer case includes an upper plate 11 covering a top and each side of the cavity 20, a base plate 13 protecting a bottom of the cavity 20, a front plate 15 forming the front of the cavity 20, and a back plate 17 protecting a back of the cavity 20.

The cavity 20, in which food is to be loaded for cooking, has a box-like shape with a front opening. That is, the food is loaded through the opening for cooking and is unloaded after the cooking through the opening. The door 40 selectively shields the cavity 20 after the loading or unloading of the food.

The cavity 20 is provided at an outer top surface with a waveguide 21 in order to guide microwave generated at a magnetron toward the cavity 20. A motor 22 is provided at an outlet of the waveguide 21 to drive a stirrer fan. The stirrer fan as it rotates distributes the microwave uniformly about the cavity 20. The waveguide 21 is also provided at an outer bottom surface of the cavity 20 as well as the outer top surface, such that the microwave can be guided both in downward and upward directions, thereby evenly cooking the food.

The electric component chamber 30 is located at a right in the outer case to accommodate a plurality of electric components for the operation of the microwave oven. In the electric component chamber 30, electric components such as a transformer 31, a magnetron 33, a blower fan 35, a capacitor 37 are mounted, and also a barrier 39 is formed between the transformer 31 and the blower fan 35. The transformer 31, blower fan 35, capacitor 37, and barrier 39 are mounted on a subplate 14 that is spaced apart from a top surface of a base plate 13.

The plurality of electric components, especially the transformer 31 and magnetron 33, are used to generate the microwave to be guided toward the cavity 20. When the electric components generate the microwave, heat is also generated in the electric component chamber 30 and thereby the temperature of electric component chamber 30 increases during the cooking. Therefore the blower fan 35 is provided to cool the electric component chamber 30 by sucking an ambient air.

Figure 2:
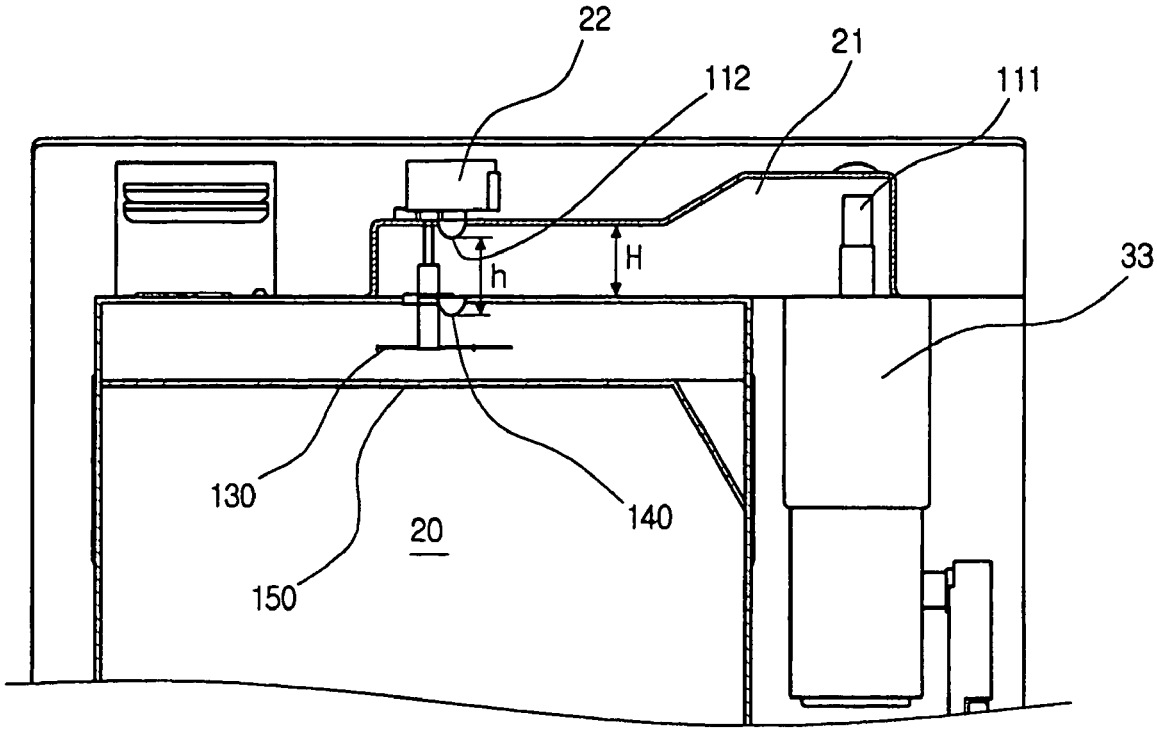
FIG. 2 is a sectional view taken on I-I' in FIG. 1.

FIG. 2 is a sectional view taken on I-I' in FIG. 1, in which a microwave radiating structure above the cavity 20 is shown.

Referring to FIG. 2, the microwave oven includes a magnetron 33 at a right side beside the cavity 20. The magnetron 33 receives a high voltage from the transformer 31, generates microwave, and radiates the microwave at its upper antenna 111 toward the waveguide 21. Since a leading end of the antenna 111 is located in the waveguide 21, the microwave generated at the magnetron 33 can be radiated toward the inside of the waveguide 21.

The waveguide 21, a passage of the microwave, includes an inlet in which the antenna 111 is inserted and an outlet located at a top center of the cavity 20. The waveguide 21 is tightly disposed on the outer top of the cavity 20.

The motor 22 is provided at the outlet of the waveguide 21 and coupled with the stirrer fan to drive the stirrer fan.

The motor 22 is fixed at a top surface of the waveguide 21 by using a motor fixing bracket. To mount the motor fixing bracket on the top surface of the waveguide 21, a coupling hole is defined in the motor fixing bracket. To mount the motor 22, a screw is applied at a right inside of the waveguide 21. Also, a screw covering part 112 is protruded from the right inside of the waveguide 21 in order to prevent the screw from exposure to the inside of the waveguide 21, such that microwave leakage between the screw and the coupling hole can be prevented. Also, the screw covering part 112 prevents the microwave from colliding with the screw. Thus, it is possible to prevent concentration and reflection of microwave in undesired direction. In addition, deterioration of the screw can be prevented.

A stirrer fan 130 is provided under the outlet of the waveguide 21, i.e., at a top center inside of the cavity 20. The stirrer fan 130, driven by the motor 22, distributes the microwave passed the waveguide 21 toward the cavity 20. That is, the microwave can be uniformly distributed about the cavity by driving the stirrer fan 130.

An upper cover 150 is provided under the stirrer fan 130, i.e., at an upper location of the cavity 20 in order to prevent the stirrer fan 130 from exposure to the cavity 20 and in order to guide airflows into and out of the cavity 20.

A convergence preventing part 140, corresponding to the screw covering part 112, is formed by recessing a portion of an outer top surface of the cavity 20 downwardly. That is, the shapes and location of the convergence preventing part 140 and screw covering part 112 are corresponding to each other. The convergence preventing part 140 is provided to compensate for interference between the microwave and the screw covering part 112.

Since the recession of the convergence preventing part 140 and the protrusion of the screw covering part 112 are corresponding to each other, a microwave passage in the waveguide 21 can have a uniform height. That is, referring again to FIG. 2, big "H" denotes a height of the waveguide 21 at a right location where its slope ends, small "h" denotes a height between the screw covering part 112 and the convergence preventing part 140, and the height "H" and "h" have the same value.

As described above, though the protrusion of screw covering part 112 narrows the microwave passage in the waveguide 21, the recession of the convergence preventing part 140 make up for the narrowed microwave passage, such the microwave passage in the waveguide 21 can maintain uniform size therethrough and thereby the microwave can pass through the waveguide 21 toward the cavity 20 without converging.

Figure 3:
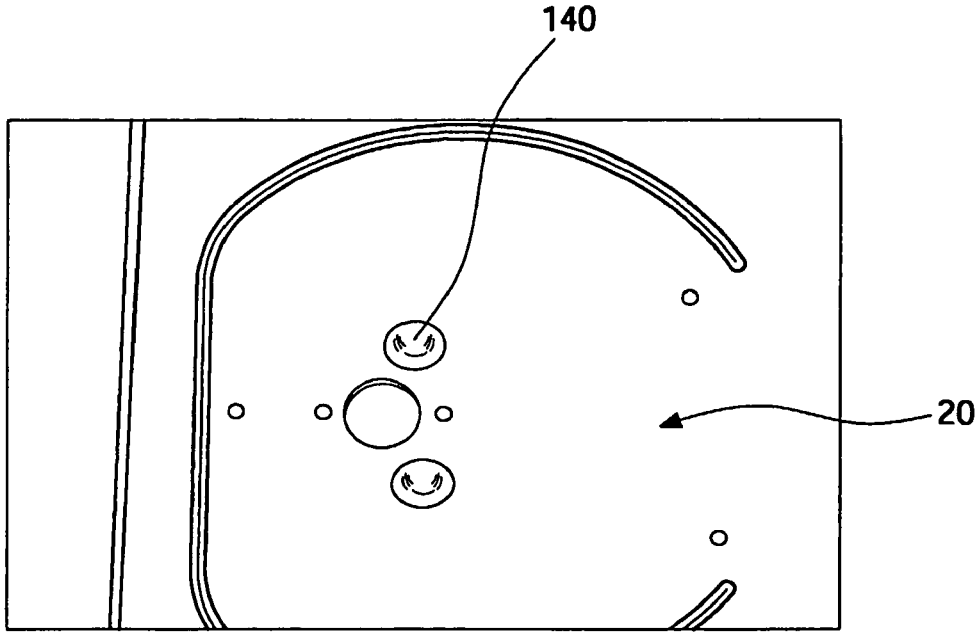
FIG. 3 is a view of a cavity of a microwave oven, viewed in the cavity upwardly.

FIG. 3 is a view of a cavity of a microwave oven, viewed in the cavity upwardly.

Referring to FIG. 3, the convergence preventing part 140 may be formed at two places in case the motor 22 is fixed with two screws at both side and thereby two screw covering parts 112 are required. If three screw covering parts 112 are formed, three convergence preventing parts 140 are also required. That is, the number and shape of the 140 correspond to those of the screw covering part 112.

In case another microwave radiating structure is provided at a lower side of the cavity 20, the convergence preventing part 140 is also formed at the lower side. That is, the location of the convergence preventing part 140 is not limited to the upper side of the cavity; the convergence preventing part 140 can be formed at any location where the microwave radiating structure is provided.

Hereinafter, forming the convergence preventing part 140 at the upper side of the cavity 20 will be described.

The cavity 20 may be formed by attaching several pieces of iron plates or by bending a long iron plate several times. When using the several pieces of iron plates for forming the cavity 20, the several pieces of iron plates may be made by a blanking using a die and press, the iron plates may be attached together for forming the cavity 20 by using a welding method, and a die for an upper iron plate may be modified to form the convergence preventing part 140 integrally with the upper plate.

When using the long iron plate for forming the cavity 20, blanking and bending are performed on the long iron plate in sequence or at the same time, in a generally method. Therefore, it is preferable to form the convergence preventing part 140 at the blanking process with a predetermined tool, for example, combination of a groove in lower die and projection at upper die.

The function of the convergence preventing part 140, prevention of the microwave convergence, will be described more fully.

The magnetron 33 generates a microwave and radiates it at the antenna 111 toward the waveguide 21. The microwave passes from the inlet of the waveguide 21 to the outlet of the waveguide 21. When the microwave passes by the protruded screw covering part 112 at the outlet of the waveguide 21, the microwave will be converged and reflected with an undesired pattern unless the recessed convergence preventing part 140 is not formed under the screw covering part 112. That is, the convergence preventing part 140 prevent the microwave passage in the waveguide 21 from being narrowed by the screw covering part 112, such that the microwave can pass the waveguide 21 without interference and convergence.

As described above, the microwave convergence in the waveguide 21 due to the screw covering part 112 can be prevented by the convergence preventing part 140.

Hereinafter, the microwave radiating structure at the lower side of the cavity 20 will be described. If the cavity has the same microwave radiating structure both at the lower side and the upper side, the lower structure can radiate microwave with the same way and operation as the upper structure.

Because of practical reason, however, the lower structure of radiating microwave is generally different from the upper structure in order to increase cooking efficiency.

Figure 4:
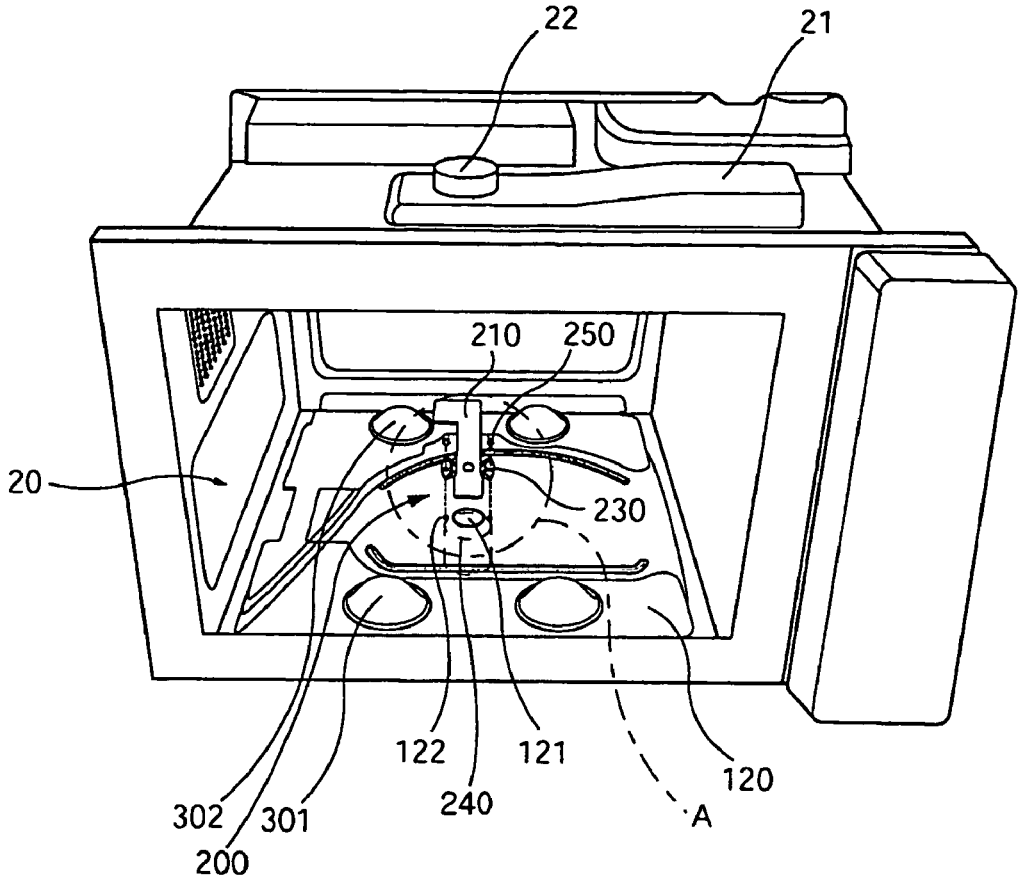
FIG. 4 is a front perspective view of a microwave oven, in which a lower plate of a cavity is shown.
Figure 5:
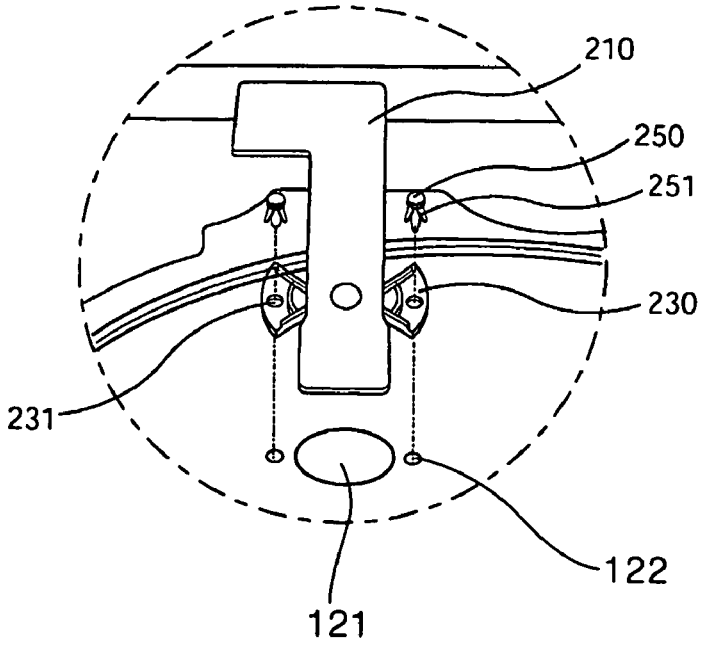
FIG. 5 is an enlarged view of a portion "A" in FIG. 4.

FIG. 4 is a front perspective view of a microwave oven, in which a lower plate of a cavity is shown, and FIG. 5 is an enlarged view of a portion "A" in FIG. 4.

Referring to FIGS. 4 and 5, there are provided a waveguide (not shown) at a lower side of the cavity 20 for guiding microwave and a motor 240 at an outlet of the waveguide for uniformly distributing the microwave about the cavity 20.

A lower plate 120 is provided at a lower side of the cavity 20 for protecting the lower side of the cavity 20. The lower plate 120 includes a through hole 121 and fixing holes 122 at a center. Through the through hole 121, a stirrer fan 200 is coupled with a shaft of the motor 240 provided at an outer surface of the lower plate 120. The fixing hole 122 is provided to mount the stirrer fan 200 on the lower plate 120. The waveguide extending from the magnetron 33 is located under the stirrer fan 200.

The stirrer fan 200 is tightly mounted on the lower plate 120. The stirrer fan 200 includes a rotating fan 210 and a holder 230. The rotating fan 210 is made of a conductive metal plate and bent at its outer end in the left direction to have a "¬"-like shape. Since the rotating fan 210 is made of a conductive metal plate, the microwave guided by the waveguide can be transmitted directly to the rotating fan 210. Also, the "¬"-like shape of the rotating fan 210 allows the transmitted microwave to be more uniformly distributed about the cavity 20 during rotation of the rotating fan 210. The shape of the rotating fan 210 is not limited to the "¬"-like shape; it can be changed.

The holder 230 is provided to rotatably mount the rotating fan 210 on the lower plate 120. The stirrer fan 200 is fixed at the lower plate 120 by inserting and fixing rivets 250 through coupling holes 231 and the lower plate 120.

Further, the lower plate 120 includes an elevated portion 300 projected upwardly. The elevated portion 300 has an upwardly narrowed shape, i.e., a hemispheric shape. The elevated portion 300 includes a front elevated portion 301 at a front of the lower plate 120, adjacent to the opening of the cavity 20, and a rear elevated portion 302. Preferably, there may be a plurality of front elevated portions 301 and a plurality of rear elevated portions 302. The front and rear elevated portions 301 and 302 distribute the microwave scattered from the rotating fan 210 more widely about the cavity 20.

The front and rear elevated portions 301 and 302 are arranged around the outside of the rotating fan 210, for preventing interference between the rotating fan 210 and the elevated portions 301 and 302 when the rotating fan 210 rotates and for reflecting the microwave scattered at the outer end of the rotating fan 210 more widely.

The front elevated portions 301 are arranged in a fort line, the rear elevated portions 302 are arranged in a rear line, and they are facing each other to form a rectangular arrangement with an evenly spaced relationship. Therefore the microwave from the rotating fan 210 can be distributed evenly throughout the cavity 20.

The front and rear elevated portions 301 and 302 are integrally formed with the lower plate 120 as shown in FIG. 5. However, separate members can be mounted on the lower plate 120 to form the elevated portion 300.

Further, the number of the elevated portion 300 may vary according to the capacity of the microwave oven or designer's selection. For example, 1800-Watt microwave oven may be provided with four elevated portions, and 1000-Watt to 1200-Watt microwave oven, relatively low capacity microwave oven, may be provided with two elevated portions. It is also apparent that the number of the elevated portion 300 may vary according to the capacity of the cavity.

Forming process of the front and rear elevated portions 301 and 302 on the lower plate 120 will be described. The lower plate 120 is generally made of a metal plate having a desired strength. The metal plate is placed between a die set having a shape corresponding to the lower plate 120 and then a press in which the die set is installed is operated to make the lower plate 120. Herein, the elevated portion 300 can be formed on the lower plate 120 by adding a shape corresponding to the elevated portion 300 to the die set.

Further, the front and rear elevated portions 301 and 302 may be made in a separate process, and then may be fixed on the lower plate 120. Preferably, a metal plate may be used to make the separate elevated portions 301 and 302. However, it is possible to make the separate elevated portion 301 and 302 with synthetic resin.

When the elevated portions 301 and 302 are made by a separate process, the metal elevated portions 301 and 302 may easily be fixed on the lower plate 120 by welding and the synthetic resin elevated portions 301 and 302 may easily be fixed on the lower plate 120 by using adhesive. Other way of fixing the separate elevated portions 301 and 302 on the lower plate 120 is possible, for example, a way of forming a groove on the 120 and a corresponding protrusion on the elevated portions 301 and 302.

A ceramic plate, on which food is to be loaded, may be positioned above the stirrer fan 200 (not shown).

The microwave distributing operation of the stirrer fan 200 and the front and rear elevated portions 301 and 302 will be described.

The magnetron 33 generates a microwave and radiates it to the waveguide. The waveguide guides the microwave to the lower side of the cavity where the stirrer fan 200 is located. The rotating fan 210 of the stirrer fan 200 receives the microwave, and distributes the microwave at its outer end toward the cavity 20 in a radial direction when the motor 240 rotates the rotating fan 210.

The radially distributed microwave collides with the front and rear elevated portions 301 that are formed around the outside of the rotating fan 210, and the collided microwave is scattered in all directions, such that the food can be exposed to the microwave evenly and thereby be cooked evenly.

That is, the elevated portion 300 allows the microwave to be uniformly distributed about the cavity 20.

As describe above, the uniform distribution of the microwave is attained by employing two structures, i.e., the elevated portion 300 at the lower side of the cavity 20 and the convergence preventing part 140 at the upper side of the cavity 20. Herein, the lower side and upper side of the cavity 20 may be provided with any one of the two structures or both the two structures, for example, the lower side with the convergence preventing part 140 and the upper side of the cavity 20 with elevated portion 300.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

Food can be cooked evenly and speedily by using a microwave oven of the present invention, in which microwave is uniformly distributed from a waveguide toward a cavity. In particularly, a convergence preventing part and an elevated portion are used to distribute the microwave more uniformly about the cavity, for the even and fast cooking.

The invention claimed is:

1. A microwave oven comprising:

a cavity for accommodating food to be cooked, of which at least one side defining an opening;

a door for shielding the opening selectively;

a magnetron disposed at an outside of the cavity, for generating microwave;

a waveguide for guiding the generated microwave into the cavity;

a stirrer fan disposed at an outlet of the waveguide, for scattering the microwave guided by the waveguide;

a motor fixed at an outside of the waveguide and having a shaft connected with the stirrer fan;

a screw covering part formed by modifying a portion of the waveguide to accommodate a motor fixing screw;

a convergence preventing part formed at a portion of the cavity, the convergence preventing part having a shape corresponding to the screw covering part and provided at a location corresponding to the screw covering part; and an elevated portion formed by modifying a portion of the cavity, for uniformly distributing the microwave scattered by the stirrer fan.

2. The microwave oven according to claim 1, wherein the waveguide is provided at an upper side and/or a lower side of the microwave oven.

3. The microwave oven according to claim 1, wherein the convergence preventing part is formed with a recessed shape toward an inside of the cavity.

4. The microwave oven according to claim 1, wherein the convergence preventing part is formed around the stirrer fan at the corresponding location.

5. The microwave oven according to claim 1, wherein the elevated portion protrudes toward an inside of the cavity.

6. The microwave oven according to claim 1, wherein the elevated portion is formed at an outside of the stirrer fan.

7. The microwave oven according to claim 1, wherein the elevated portion has a substantially hemispheric shape.

8. The microwave oven according to claim 1, wherein the number of the elevated portion is plural and the plurality of elevated portions are arranged facing each other around the stirrer fan.

9. The microwave oven according to claim 1, wherein the elevated portion is integrally formed with a plate of the cavity.

10. The microwave oven according to claim 1, wherein a vertical distance between the screw covering part and the convergence preventing part is equal to a vertical distance between the cavity and the waveguide.

11. A microwave radiating structure of a microwave oven comprising:

a magnetron disposed at an outside of a cavity, for generating microwave;

a waveguide for guiding the generated microwave into the cavity;

a stirrer fan disposed at an outlet of the waveguide, for scattering the microwave guided by waveguide;

a motor fixed at an outside of the waveguide and having a shaft connected with the stirrer fan; and a convergence preventing part provided at a nearby position of the motor, the convergence preventing part being recessed toward an inside of the cavity, wherein the waveguide is modified to form a screw covering part at a position where the motor is fixed, and the convergence preventing part is formed to have a shape corresponding to the screw covering part and being provided at a location corresponding to the screw covering part.

12. The microwave radiating structure according to claim 11, wherein the number of the convergence preventing part is plural and the convergence preventing parts are arranged around the stirrer fan at the corresponding locations.

13. The microwave radiating structure according to claim 11, wherein the stirrer fan is provided at an upper side and/or lower side of the cavity.

14. The microwave radiating structure according to claim 11, wherein the convergence preventing part is formed by modifying the waveguide.

15. The microwave radiating structure according to claim 11, wherein a vertical distance between the screw covering part and the convergence preventing part is equal to a vertical distance between the cavity and the waveguide.

* * * * *